US008998488B2

(12) United States Patent
Cole

(10) Patent No.: US 8,998,488 B2
(45) Date of Patent: Apr. 7, 2015

(54) RADIOGRAPHIC PROJECTOR

(75) Inventor: Christopher John Cole, Burnopfield (GB)

(73) Assignee: SPEC Intellectual Property, LLC, St. Rose, LA (US)

( * ) Notice: Subject to any disclaimer, the term of this patent is extended or adjusted under 35 U.S.C. 154(b) by 520 days.

(21) Appl. No.: 13/201,128

(22) PCT Filed: Feb. 9, 2010

(86) PCT No.: PCT/GB2010/050199
§ 371 (c)(1),
(2), (4) Date: Aug. 11, 2011

(87) PCT Pub. No.: WO2010/092376
PCT Pub. Date: Aug. 19, 2010

(65) Prior Publication Data

US 2011/0309272 A1 Dec. 22, 2011

(30) Foreign Application Priority Data

Feb. 13, 2009 (GB) ..... 0902353.2

(51) Int. Cl.
*G21F 5/015* (2006.01)
*G21F 5/02* (2006.01)
(Continued)

(52) U.S. Cl.
CPC *G21F 5/015* (2013.01); *G21F 5/02* (2013.01); *G21F 5/12* (2013.01); *G21F 1/085* (2013.01)

(58) Field of Classification Search
CPC ..... G21F 5/015; G21F 5/02; G21F 5/12
USPC ..... 250/506.1; 378/199, 200, 203
See application file for complete search history.

(56) References Cited

U.S. PATENT DOCUMENTS 2,876,363 A 3/1959 Forrer et al.
4,314,157 A 2/1982 Gaines
4,516,256 A 5/1985 Wapperom
(Continued)

FOREIGN PATENT DOCUMENTS

EP 0 513 512 A2 11/1992
EP 0513512 B1 * 11/1992 ..... G01N 23/04
(Continued)

OTHER PUBLICATIONS

International Search Report and Written Opinion under date of mailing of Aug. 13, 2011 in connection with PCT/GB2010/050199.

*Primary Examiner* — Hoon Song
*Assistant Examiner* — Danielle Fox
(74) *Attorney, Agent, or Firm* — Quarles & Brady LLC

(57) ABSTRACT

A radiographic projector (10) for housing and projecting a radioisotope for use in radiography is described. The front end of the projector has a chamfered surface (12) for receiving an ancillary shielding component. The material used for the front end surface of the projector is tungsten powder in a less dense material matrix. A locking mechanism (30) for a projector is described, including a locking bar for locking a source holder in the projector. The locking mechanism includes an interlock section for retaining the locking bar in an unlocked position while a source holder is not in its storage position, and a latch section for latching the locking bar in the unlocked position prior to engagement of the interlock section. A holster for mounting a radiographic projector and a retraction cage for a remote windout mechanism are also described.

15 Claims, 10 Drawing Sheets

(51) Int. Cl.
*G21F 5/12* (2006.01)
*G21F 1/08* (2006.01)

(56) References Cited

U.S. PATENT DOCUMENTS 5,065,033 A 11/1991 Parsons
5,418,379 A 5/1995 Parsons
5,834,788 A 11/1998 Fu et al.
6,166,388 A 12/2000 Weir et al.
6,781,114 B1 8/2004 Grenier

FOREIGN PATENT DOCUMENTS

EP 0 859 370 A1 8/1998
EP 0859370 B1 * 8/1998 ..... G21F 5/015

* cited by examiner

RADIOGRAPHIC PROJECTOR

CROSS-REFERENCE TO RELATED APPLICATIONS

This application claims priority to PCT International Application No. PCT/GB2010/050199 filed on Feb. 9, 2010, which claims priority to Great Britain Application No. 0902353.2 filed on Feb. 13, 2009, both of which are fully incorporated by reference herein.

FIELD OF THE INVENTION

The present invention relates to a radiographic projector for housing a radioisotope for use in radiography. The invention relates particularly, but not exclusively, to a lock mechanism for a radiographic projector. The invention also relates to a radiation shield of a radiographic projector.

BACKGROUND OF THE INVENTION

A source of high energy gamma photons can be used to take radiographs (photographs using photons having higher energy than visible light) of metal structures such as castings or welds, similarly to the use of x-rays for radiographic imaging. Both techniques can be used to ascertain if flaws, defects or cracks exist in a piece being tested without needing to dissect the piece to make a visual examination.

For industrial applications, the piece being tested might be a subsection or assembly intended as part of a larger critical appliance, for example a turbine blade. Alternatively, it might be a critical component in itself, for example a pipeline section. In each of these examples, failure of the component would have catastrophic repercussions and as such failure is not acceptable.

Although X-ray imaging can be used for certain applications, there are situations in which the use of x-ray is unsuitable, due to limitations on power supply or access, or due to ambient atmospheric conditions (the presence of flammable gaseous for example). It is often preferable to use radioisotopes for imaging, due to the increased flexibility and accessibility offered by this technique. A radiographic projector system can be used for radiographic imaging.

A radiographic projector is a device used to house a radioisotope used in the process of gamma radiography. The projector allows transportation and use of the radioisotope in a safe and reliable manner. For many years, the industry standard has been a remote windout system. This type of projector system can be remotely operated to project the radioisotope from the shielded, stored position inside the projector to the working position. In this way, a highly dangerous radioactive source can be manipulated from a distance, thereby minimising the exposure of the operator to harmful radiation.

The remote windout system comprises three main components: the projector, a windout, and guide tubing. The guide tubing can be connected to the front of the projector to guide the radioisotope to the working position. The windout can be connected to the rear of the projector and is commonly made up of a gear wheel with a handle for cranking, a control cable, cable housings for the control cable to reside or run in, and a connector for connecting the windout to the projector. In operation, the control cable is coupled to the radioisotope holder, and cranking the gear wheel causes the control cable to run through the cable housings to progress the source along a channel inside the projector and out of the projector through the guide tube. The windout can be operated at a safe distance from the projector, thereby allowing the radioisotope to be progressed from the projector remotely. The operator is exposed to a lower radiation dose due to operating the projector system from a large distance away.

Further accessories may be coupled to the projector system to increase the safety or flexibility of the system. For example, a guide tube may be connected to the front of the projector to guide the source to the work position when it is exposed by the windout system.

A problem associated with coupling shielded ancillary components such as collimators to the front of the projector is that radiation may escape unshielded through a gap between the collimator and the projector. This problem is known as hot passing.

EP 0 513 512 A2 discloses a gammagraphy apparatus including a locking mechanism for ensuring that a radioisotope remains locked inside a shielded body until a windout assembly and ancillary component are correctly attached to the body. Once these components are correctly attached, a locking slide can be moved to unlock the source holder. A spring biased locking block engages and holds the locking slide in the unlocked position until the radioisotope is safely returned to the shielded body. In this apparatus, the locking block is coupled to the movement of the source holder, such that the source holder is pushed forward by the locking block on moving the locking bar to the unlocked position. Winding the source holder back to its original position releases the locking block from the locking slide to lock the source holder in place.

A disadvantage of this type of mechanism is that, if the source holder cannot be pushed forward by the spring biased locking block, for example, due to an excessive frictional force associated with the attached windout cables, the interlock will not operate. In order to compensate the frictional forces, the spring value associated with the locking block is usually increased. However, this has the disadvantage of generating more wear in the lock and making assembly of the lock more difficult. More importantly, an increased spring value may be dangerous, because if the resistive force of the windout cable friction is not present, the source holder may be pushed forward from the stored position or perhaps even from the shielded container when an operator is in close vicinity of the projector.

SUMMARY OF THE INVENTION

According to a first aspect of the present invention, there is provided an apparatus for housing a radioisotope, the apparatus comprising:

a first radiation shield for housing a radioisotope, the radiation shield defining a surface for receiving a second radiation shield;

wherein a first portion of said surface defines an aperture through which a radioisotope located in the first radiation shield may be projected out of the first radiation shield; and a second portion of said surface is inclined relative to a plane of said aperture.

By providing a surface having a second portion inclined relative to a first portion, the present invention provides the advantage that, when a second radiation shield is mounted to said surface, radiation emitted by a radioisotope located at the interface between the first and second radiation shields cannot travel along the interface without passing through the first or second radiation shields.

In one embodiment, the second portion surrounds the first portion.

In one embodiment, the first radiation shield comprises a channel along which a radioisotope may be moved, the channel being in communication with the aperture.

In one embodiment, the first portion is substantially orthogonal to the channel.

In one embodiment, the first portion of said surface is located at an end of the first radiation shield, and the second portion of the surface is a chamfered edge of the first radiation shield.

The apparatus may further comprise a connector for connecting said first radiation shield to said second radiation shield.

The connector may be provided on said surface.

Preferably, the surface of said first radiation shield is formed of a radiation absorbent material.

Preferably, said radiation absorbent material comprises at least one of depleted uranium, tungsten, lead, or tungsten powder in a binder.

The apparatus may further comprise a second radiation shield, adapted to engage said surface of said first radiation shield.

The second radiation shield may be a collimator.

The second radiation shield may be a guide tube.

According to a second aspect of the present invention, there is provided an apparatus for housing a radioisotope, the apparatus comprising:

a first radiation shield for housing a radioisotope, the first radiation shield defining a surface for engaging an second radiation shield;

wherein a first portion of said surface defines an aperture through which a radioisotope located in the first radiation shield may be projected out of the first radiation shield; and said surface of said first radiation shield is formed of a radiation absorbent material.

An advantage of the present invention is that, when said surface of the first radiation shield is engaged to the second radiation shield, there is no gap between the radiation absorbent material of the first radiation shield and the second radiation shield.

Preferably, the radiation absorbent material comprises tungsten.

Preferably, the radiation absorbent material comprises tungsten powder in a less dense material matrix.

An advantage of using tungsten, tungsten alloy or tungsten powder in a less dense material matrix is that these materials do not need to be encased in a protective shell, and can therefore form the outermost surface of the radiation shield. In contrast, depleted uranium has a low level of radioactivity and must therefore be encased in an inert metal such as steel, to avoid contamination of an operator. Shielding materials having a low melting point, such as lead, must be entirely encased by a metal having a melting point above 800° C., to contain the shielding material in case of fire. Tungsten powder in a less dense material matrix is particularly preferable as it is lighter.

According to a third aspect of the present invention, there is provided a locking mechanism for a radiographic projector, the radiographic projector being adapted to hold a radioactive source in a source holder, and comprising a housing defining a channel along which the source holder is adapted to be moved between a storage position inside the housing and an exposed position outside of the housing, wherein the locking mechanism is adapted to lock the source holder in a storage position and comprises:

a first locking member moveable between a locked state preventing movement of the source holder out of the storage position and an unlocked state allowing movement of source holder out of the storage position;

wherein the first locking member is biased towards the locked state;

a second locking member being adapted to prevent movement of the first locking member to the locked state when the source holder is not in the storage position, and to allow movement of the first locking member to the locked state when the source holder is in the storage position; and a third locking member, adapted to engage the first locking member, as a result of movement of the first locking member from the locked state to the unlocked state, to retain the first locking member in the unlocked state, and adapted to disengage said first locking member when said second locking member prevents movement of the first locking member to a locked state.

An advantage of the present invention is that it includes a third locking member in addition to the second locking member, or interlock member, which enables an operator to unlock the source holder by moving the first locking member to an unlocked state in which it is retained by the third locking member. The operator is therefore able to retreat to safe distance before the interlock member is engaged.

Advantageously, the operator does not need to approach the projector to release the third locking member, because the third locking member can be automatically released when the second locking member engages the first locking member. This means that the first locking member can return to the locked state upon release of the second locking member, which occurs when the source holder is returned to the storage position. Therefore, the source holder is automatically locked in place when it is returned to the storage position, allowing the operator to remain at a safe working distance from the projector and the source until the source is locked inside the projector.

Preferably, the third locking member is decoupled from the source holder, allowing the third locking member to latch the first locking member in the unlocked state without movement of the source holder along the channel.

Advantageously, this enables the first locking member to be unlocked in a safe manner, because depressing the first locking member to the unlocked position in which it is latched by the third locking member does not cause or require movement of the source holder.

In one embodiment, one of the third locking member and the first locking member comprises at least one detent, and the other of the third locking member and the first locking member comprises at least one recess for engaging with the or each respective detent, and wherein the third locking member is biased towards the first locking member.

In one embodiment, release of the third locking member from the first locking member, by engagement of the second locking member with the first locking member, results in misalignment of the or each detent relative to the or each respective recess.

In one embodiment, the second locking member is biased towards engagement with the first locking member.

In one embodiment, the second locking member is movable in a direction parallel to the axis of the channel, and is biased along the axis of the channel in a forward sense.

In one embodiment, the presence of a source holder in the storage position in the radiographic projector blocks the second locking member from engaging the first locking member.

Advantageously, this means that the source holder remains stationary in the projector when the first locking member is moved to the unlocked state.

In one embodiment, the second locking member is adapted to be coupled to the source holder by a tube through which source holder passes, wherein an end portion of the source holder has a diameter larger than the internal diameter of the tube, such that retraction of the source holder to its storage position causes the end portion of the source holder to exert a force on said tube and said second locking member to move the second locking member in a rearward sense.

The second locking member may be integrally formed with the tube.

In one embodiment, the first locking member is slidable in a direction transverse to the axis of the channel.

The locking mechanism may further comprise first and second locking pins engageable with the first locking member in the locked state, wherein displacement of the first locking pin is actuated by coupling a guide apparatus to the projector, and displacement of the second locking pin is actuated by coupling a remote wind-out apparatus to the projector, and wherein the displacement of the first and second locking pins frees the first locking member for movement to the unlocked state.

According to a fourth aspect of the present invention, there is provided a remote wind-out mechanism for a radiographic projector having a housing adapted to receive a source holder for holding a radioactive source, wherein the source holder is adapted to move along a channel in said housing, the remote wind-out mechanism comprising:

a cable adapted for attachment to the source holder of the radiographic projector;

a winding device for moving the cable relative to the projector, for moving the source holder into and out of the housing;

an outer sheath connectable to the housing such that a first portion of the cable passes through the sheath; and a windout housing for receiving a second portion of the cable.

An advantage of the present invention is that the windout assembly requires only one cable housing or sheath. This allows the windout assembly to be lighter and more reliable.

The second portion of the cable is spooled inside the windout housing.

According to a fifth aspect of the present invention, there is provided a holster for supporting a radiographic projector, the radiographic projector having a housing comprising a shielding material for shielding a radioactive source, the holster comprising:

first mounting means for releasably securing the holster to a work surface;

second mounting means for releasably securing the radiographic projector to the holster;

wherein the holster comprises a surface adapted to matingly engage the radiographic projector for repeatably positioning the radiographic projector on the holster.

An advantage of the present invention is that it provides a means for aligning the projector with respect to a work site or work piece, without manipulating the projector itself, which can be very heavy. Instead, the holster can be aligned and fixed in position, after which the projector can be installed on the holster at the last moment, thereby reducing the radiation dose to which the operator is exposed. A further advantage is that the projector can be removed for storage, leaving the holster in place, and subsequently reinstalled in the same position without needing to repeat the alignment procedure.

BRIEF DESCRIPTION OF THE DRAWINGS

A preferred embodiment of the present invention will now be described, by way of example only and not in any limitative sense, with reference to the accompanying drawing, in which.

DETAILED DESCRIPTION OF PREFERRED EMBODIMENT

Figure 1:
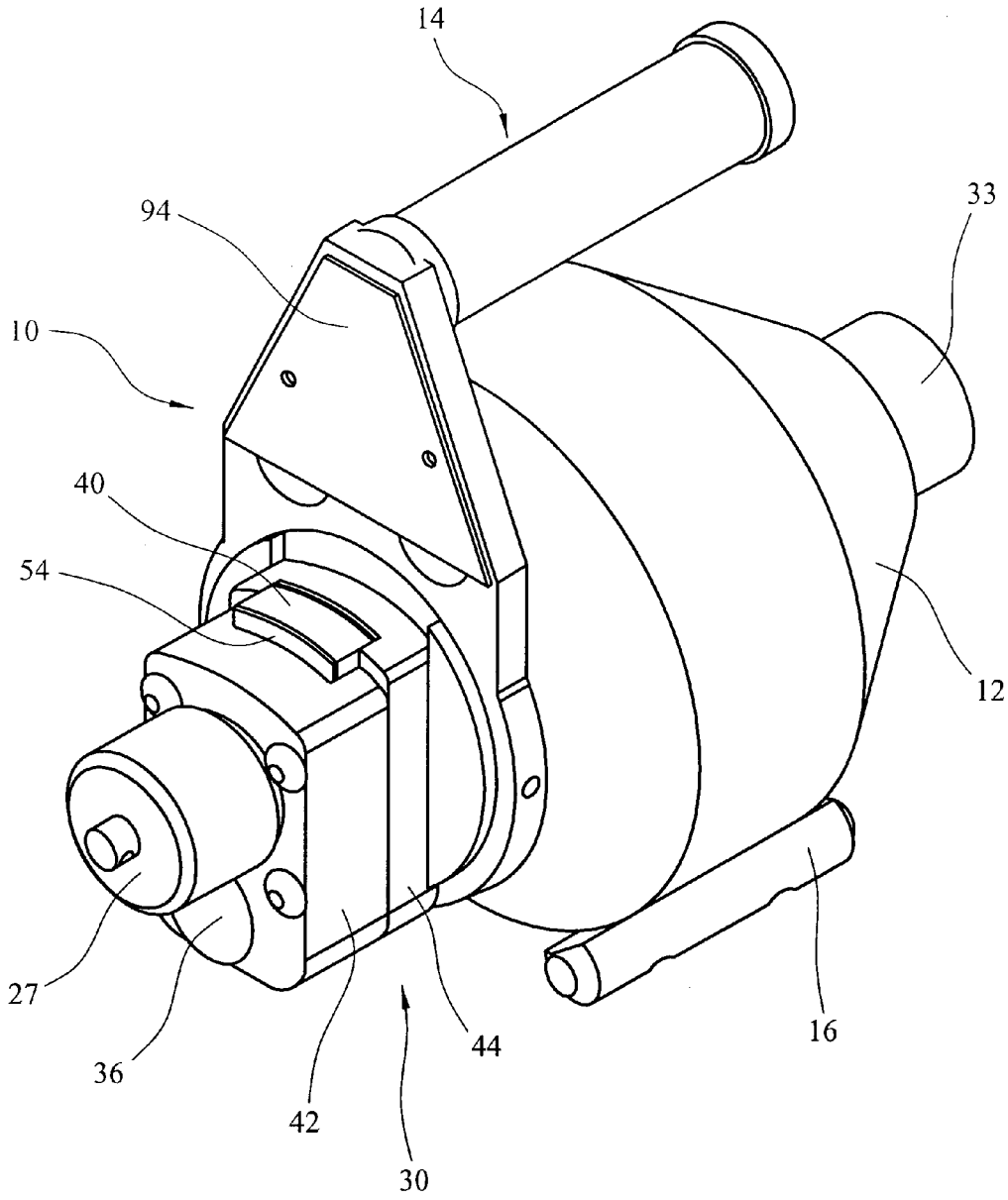
FIG. 1 shows a perspective view of a radiographic projector embodying the present invention.
Figure 2:
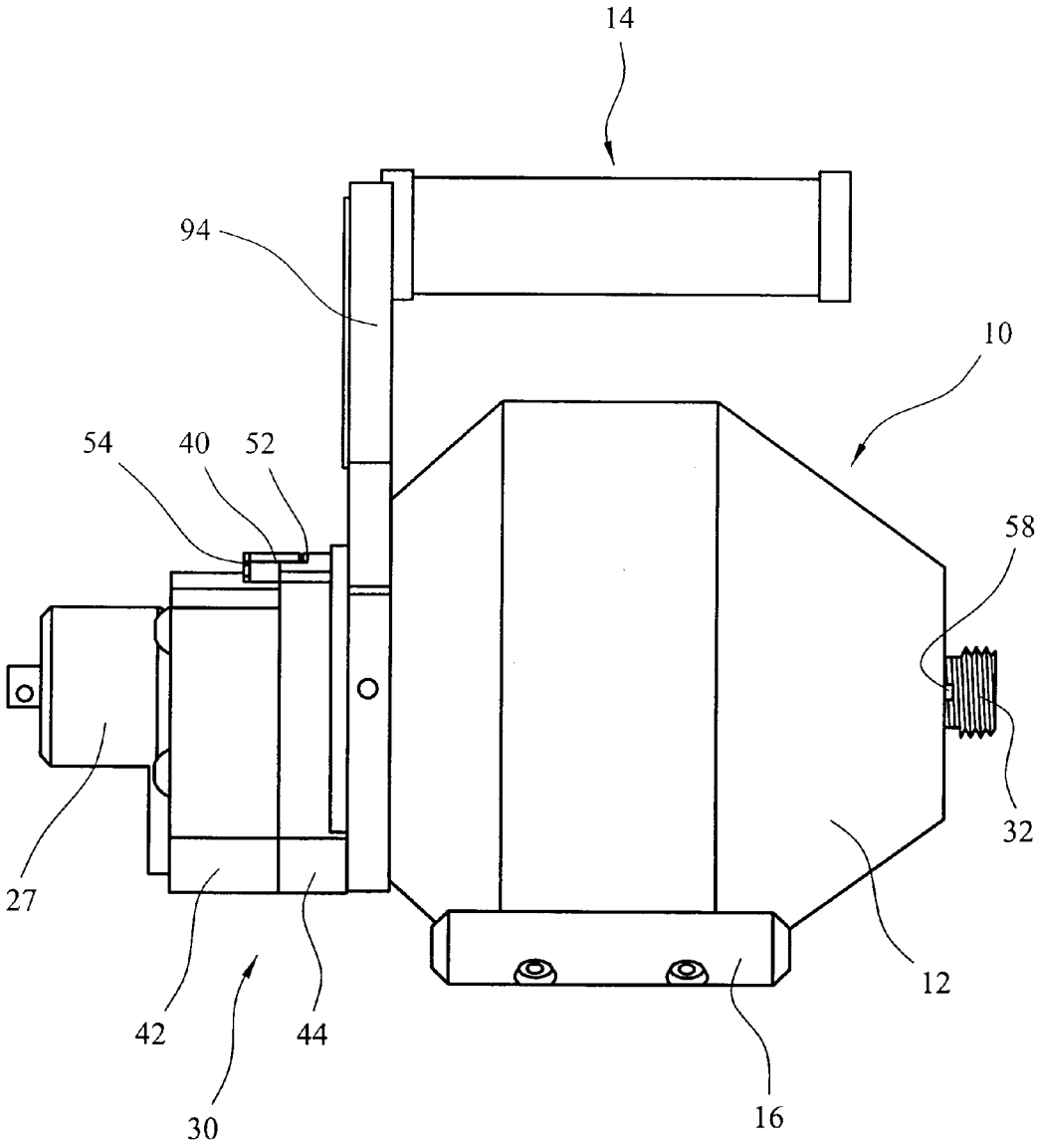
FIG. 2 shows a side view of the radiographic projector of FIG. 1.
Figure 3B:
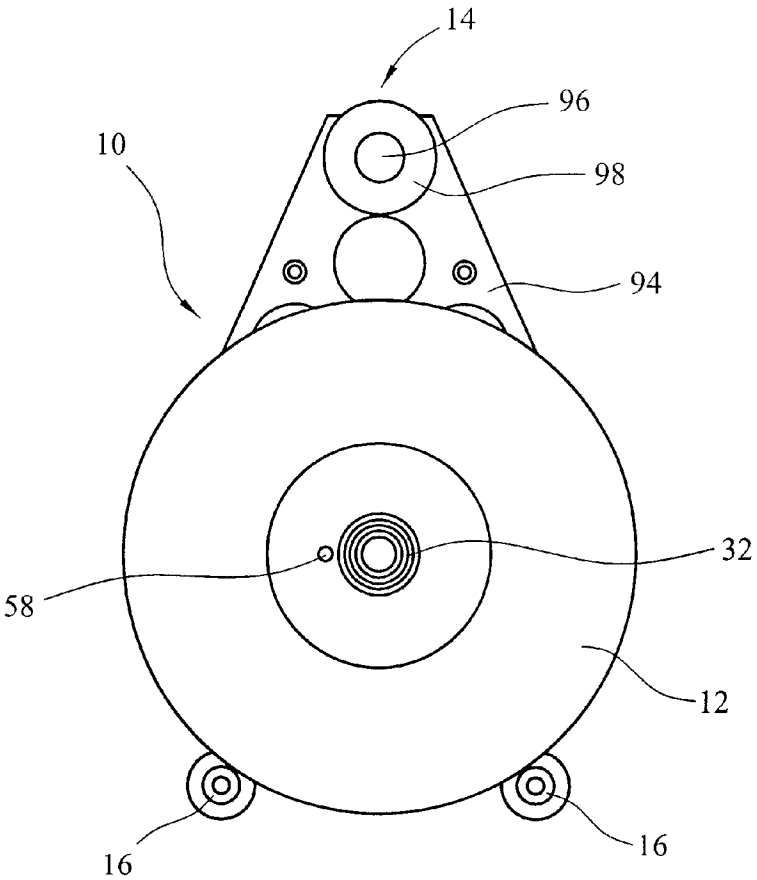
FIGS. 3A and 3B show a rear view and a front view respectively of the radiographic projector of FIG. 1.
Figure 3A:
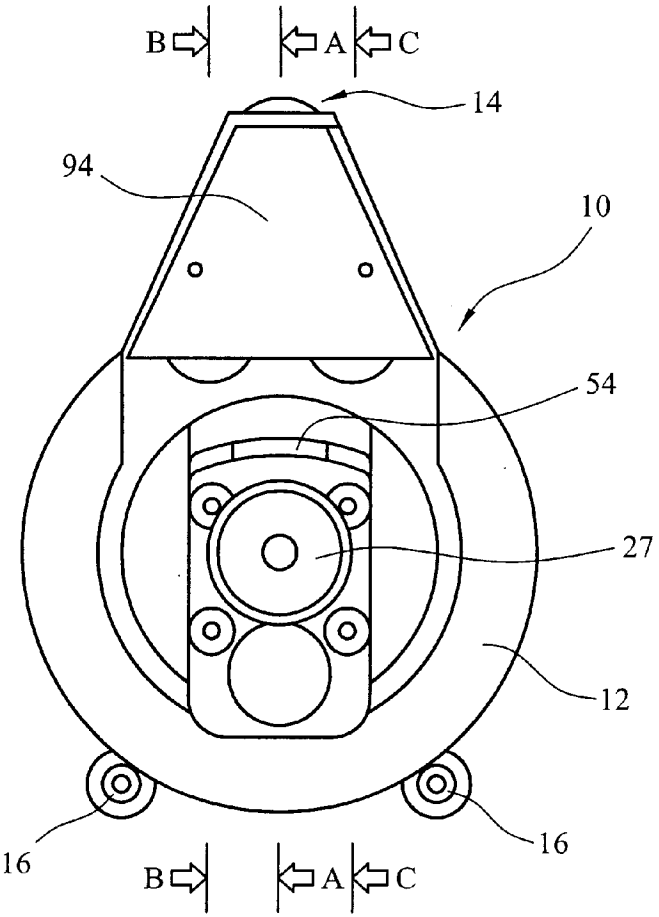

With reference to FIGS. 1 to 3, a radiographic projector 10 comprises a radiation shield 12 formed from tungsten powder suspended in a lighter material matrix. Alternative shielding materials include depleted uranium, lead, elemental tungsten and tungsten alloy. However, tungsten powder suspended in a lighter material matrix is preferred as it is resistant to high temperatures, and can be easily machined for forming different shapes. The material is made by blending a powdered material into a lighter material. This is then roughly formed into shape under high pressure then sintered, which melts the lighter material encompassing the tungsten. This process results in a piece comprising mostly tungsten (usually 90-95%) that can be formed at very low temperature compared with that required for forming elemental tungsten, and is also easier and cheaper to machine due to the impurities and the tungsten not being bonded to itself fully.

The shape of the radiation shield 12 has been designed to minimize the mass and volume of the radiation shield 12, whilst maintaining certain minimum dimensions required for safe operation of the projector 10.

The projector 10 is provided with a handle assembly 14, and feet 16.

Figure 4:
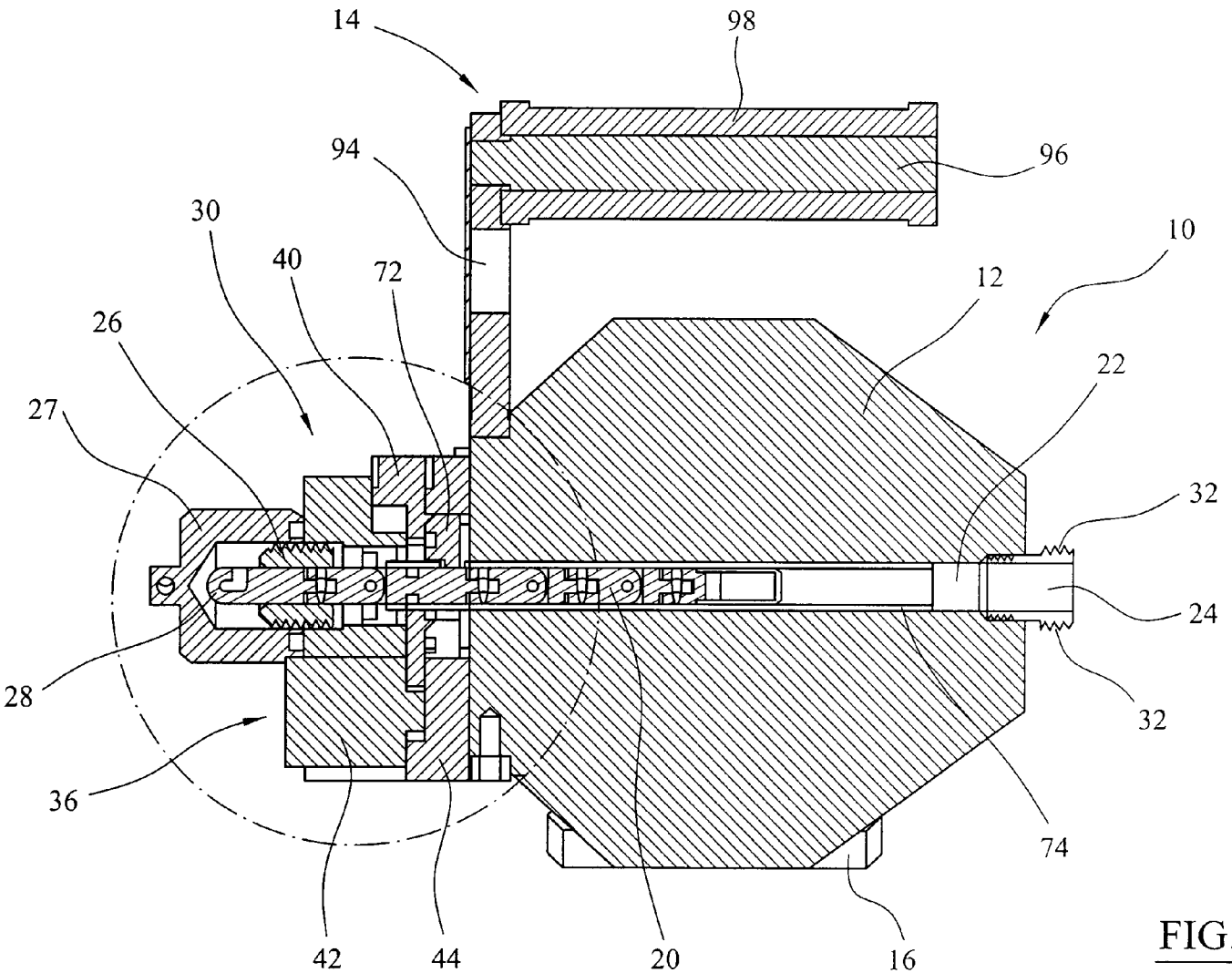
FIG. 4 shows a cross-sectional view of the plane A-A of a radiographic projector embodying the present invention.
Figure 5:
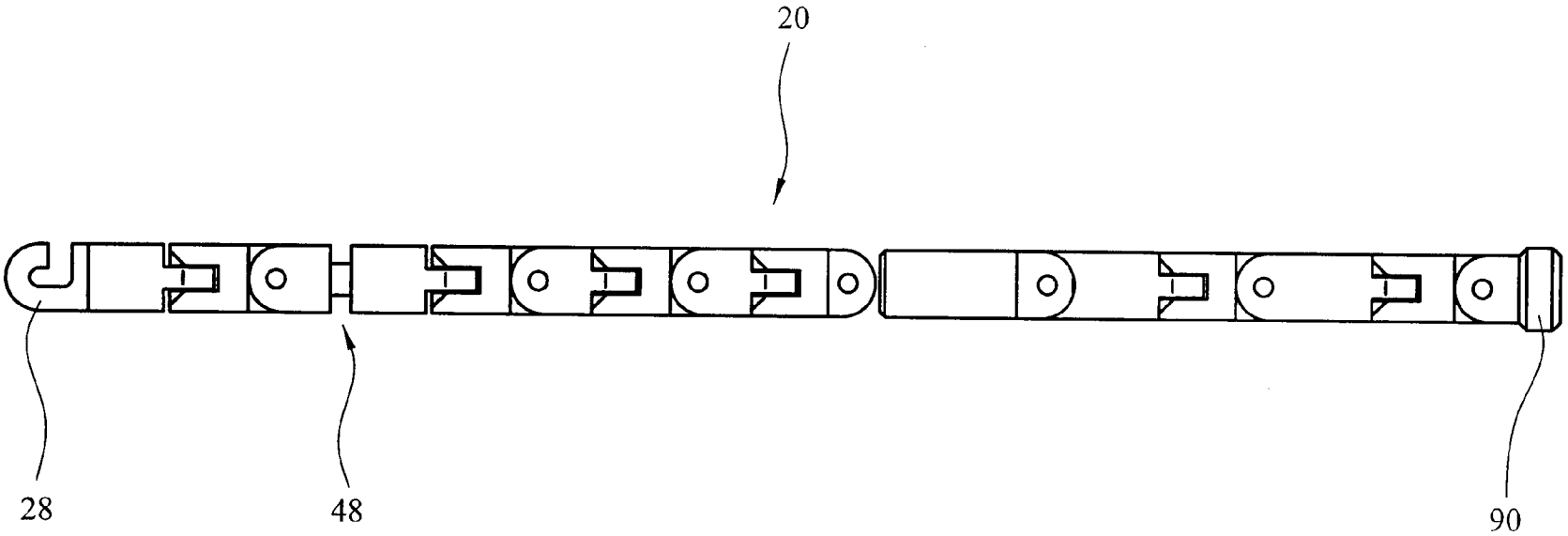
FIG. 5 shows a source holder for use with the radiographic projector of FIGS. 1 to 4.

With reference to FIGS. 4 and 5, a radioisotope 18 is housed in a source holder 20, which is received in a channel 22 in the radiation shield 12 of the projector 10. The source holder 20 is an articulated chain, shown in FIG. 5. The source holder 20 is also made of tungsten powder suspended in a lighter material matrix. The radioisotope 18 is housed part way along the source holder so that it is shielded in both the forward and backward directions by sections of the source holder 20.

In order to use the radioisotope source 18 for radiographic imaging, the source holder 20 must be progressed along the channel 22 to expose the source 18 through the opening 24 at the end of the channel 22. This is achieved using a windout assembly, which can be connected to a connector 26 provided at the rear of the radiation shield 12. A control cable of the windout assembly is coupled to a hook section 28 at the rear end of the source holder 20. At the rear of the projector 10, there is also a lock assembly 30, secured to the radiation shield 12. The lock assembly 30 allows the source holder 20 to be locked in the radiation shield 12, so that it cannot be wound out of the radiation shield 12.

Figure 6:
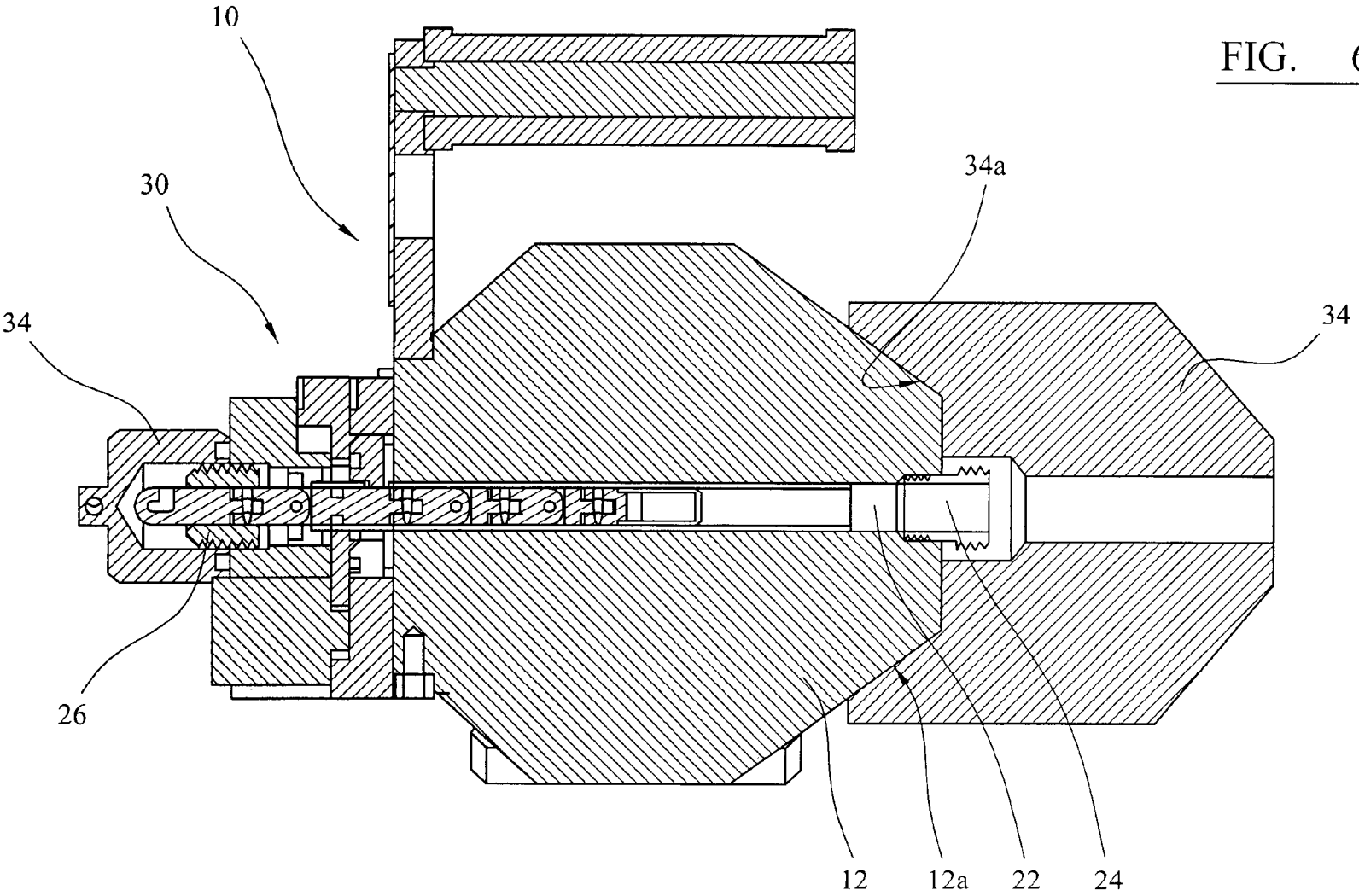
FIG. 6 shows a radiographic projector embodying the present invention, connected to a shielded ancillary component.
Figure 7:
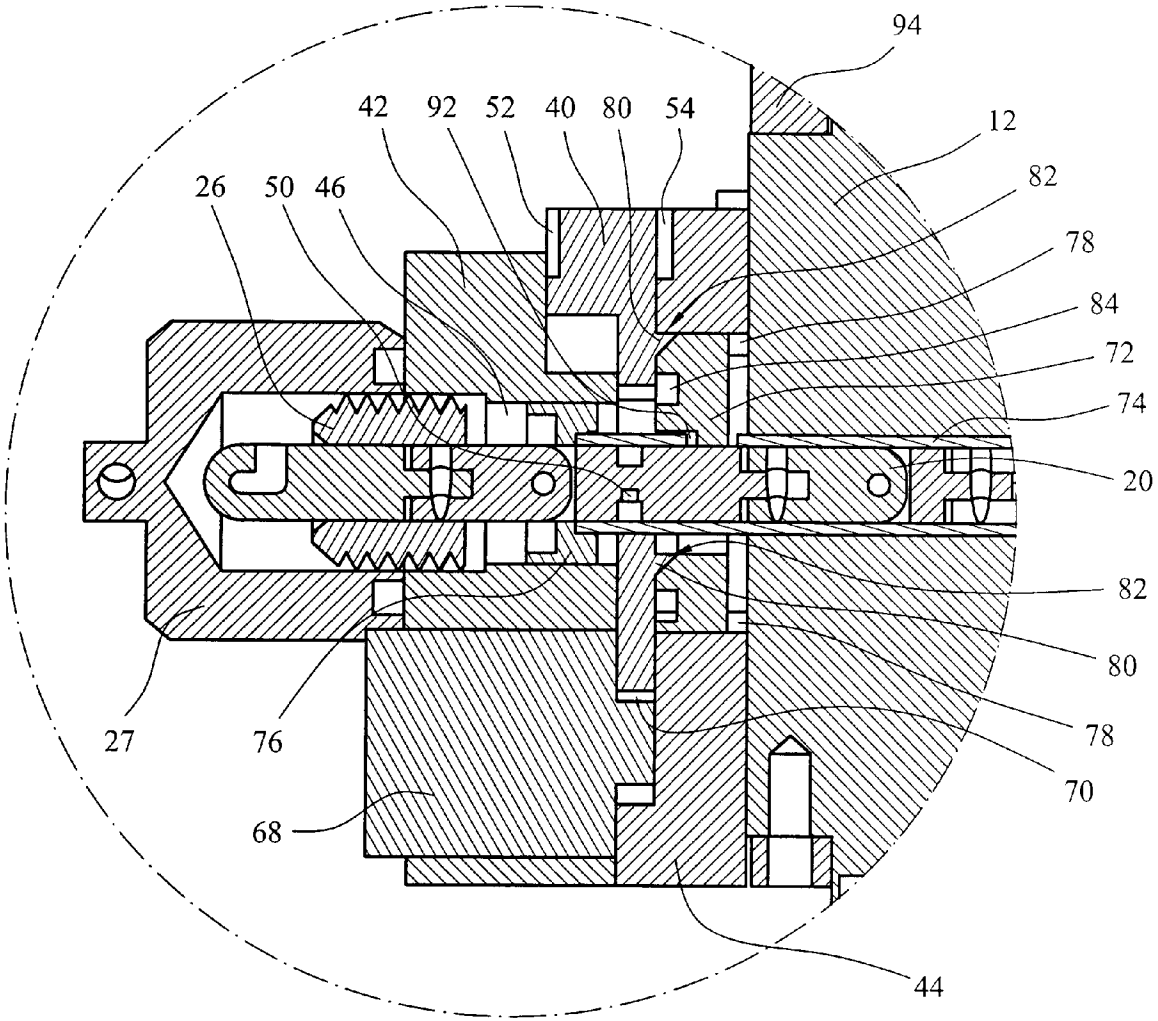
FIG. 7 is an enlarged view of the area of FIG. 4 encircled by a dashed line.

At the front of the radiation shield 12 there is a further connector 32, which allows an ancillary component 34 to be connected to the projector 10, as shown in FIG. 6. The ancillary component 34 may be, for example, a collimator or a guide tube. Using the windout mechanism, the source 18 can be progressed along the channel 22 into the ancillary component 34.

The connectors 26 and 32 for attaching the guide tube (or shielded ancillary component 34) and the windout to the projector are threaded screw connectors. However, other types of connector, such as quick release connectors, may be used. Screw caps 27, 33 are provided for closing the connectors 26, 32 when the windout assembly and the ancillary component 34 are not installed on the projector 10, and restrict the passage of dirt and debris into the projector 10 when it is not in use.

With reference to FIG. 6, the configuration of a front end of the radiation shield 12 will be described. A shielded ancillary component 34 may be installed on the front end of the radiographic projector 10 by means of the connector 32. The radioisotope 18 may be progressed along the channel 22 and through opening 24 into the ancillary component 34 by operation of the windout assembly. In the preferred embodiment, the shielded ancillary component 34, like the radiation shield 12, is formed from a tungsten powder suspended in a lighter material matrix. In contrast to depleted uranium, which is conventionally used as a shielding material in radiographic projectors, this tungsten material has the advantage that it does not need to be encased in an inert material. This means that, when a shielded ancillary component 34 is mated to the front of the projector 10, there is no gap in the shielding material at the interface between the radiation shield 12 and the ancillary component 34. In contrast, radiation shields and collimators made of depleted uranium are typically encased in a protective steel housing, which does not itself provide effective radiation shielding. The steel housings act as a spacer between the depleted uranium shielding material of the radiation shield and collimator, resulting in a gap in the shielding material at the interface. Radiation can therefore propagate unshielded through the steel housing, at the interface between the radiation shield and collimator. This results in a peak in the intensity of radiation detected outside the projector system, known as a hot spike.

In a preferred embodiment of present invention, the front end of the radiation shield 12 has a chamfered profile 12*a* adapted to be mated to a matched surface 34*a* of the ancillary component 34, as shown in FIG. 6. This profile ensures that even when the radioisotope 18 is positioned at the opening 24, at the interface between the radiation shield 12 and the ancillary component 34, there is no possibility of radiation escaping directly along any gap in the shielding at the interface, because the specially shaped interface between the radiation shield 12 and the ancillary component 34 ensures that there are no straight line paths along the interface from the opening 24 to the exterior of the radiation shield 12.

In the preferred embodiment of the present invention, the chamfered profile of the front end of the radiation shield 12, coupled with the tungsten material used in the radiation shield 12, enables ancillary shielding components to be mated with no gap to the front of the radiation shield 12. This allows a radioisotope 18 housed in the radiographic projector 10 to be moved from the radiographic projector 10 into the ancillary component 34 with there being no instance where the radioisotope 18 is unshielded.

With reference to FIGS. 4 and 7 to 9, the lock assembly 30 for locking the source holder 20 in the radiation shield 12, will be described. The lock assembly 30 is secured to the radiation shield 12 and has been designed to allow the projector 10 to comply with International Standard 3999:2004. The lock assembly 30 ensures that the radioisotope 18 remains locked in the radiation shield 12 until:

- the control cable of the windout assembly is properly attached to the source holder 20;
- the windout assembly, in particular the control cable housing, is connected to the projector 10;
- the guide tube or shielded ancillary component 34 is attached correctly to the front of the projector 10; and
- a mechanical lock 36 is unlocked.

The lock assembly 30 includes a locking bar 40, located between front 42 and rear 44 plates of the lock assembly 30. The locking bar 40 can slides vertically between a raised (locked) position and a lowered (unlocked) position and has an opening 46 through which the source holder 20 passes. The locking bar 40 is biased upwards by springs acting between the locking bar 40 and the rear plate 44. When the locking bar 40 is in the raised position, the source holder 20 is free to move along the channel 22. The locking bar 40 can be depressed such that a fin 50 on the locking bar 40 engages a recess 48 in the source holder 20, thereby locking the source holder 20 and the radioisotope 18 inside the projector 10. The source holder 20 can only be locked in place if it is in its correct storage position, with the radioisotope 18 safely shielded inside the projector 10, and the recess 48 of the source holder 20 aligned with the fin 50 of the locking bar 40.

When the locking bar 40 is in the raised (locked) position it stands proud of the front plate 42 of the lock assembly 30. A coloured plate 52, of plastics material such as Perspex, displaying the word 'closed' is attached to the top portion of the locking bar 40 and is visible when the locking bar 40 is raised. When the locking bar 40 is depressed to the unlocked position, it resides on the same level as the front plate 42, so that the coloured plate 52 is obscured. In this position, a second coloured plate 54, attached to the rear plate 44 of the lock assembly 30 and displaying the word 'open', becomes visible. This is required by the ISO 3999:2004 standard.

Figure 8:
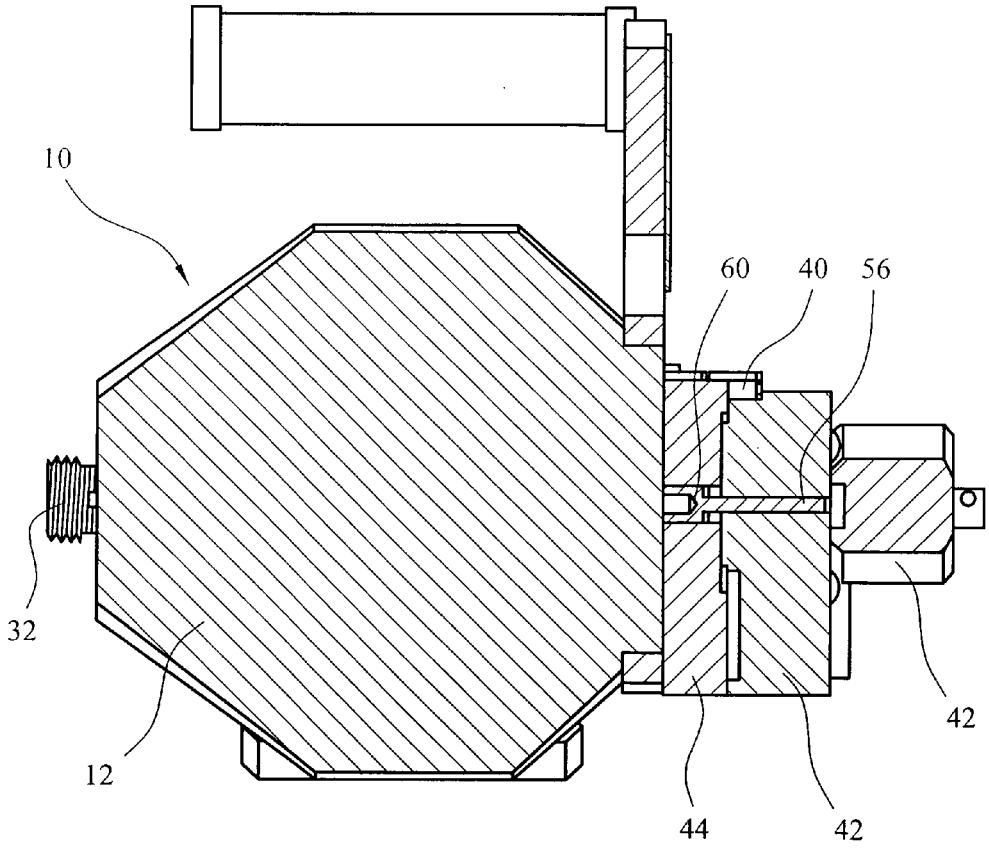
FIG. 8 shows a cross-sectional view of the plane B-B of a radiographic projector embodying the present invention.
Figure 9:
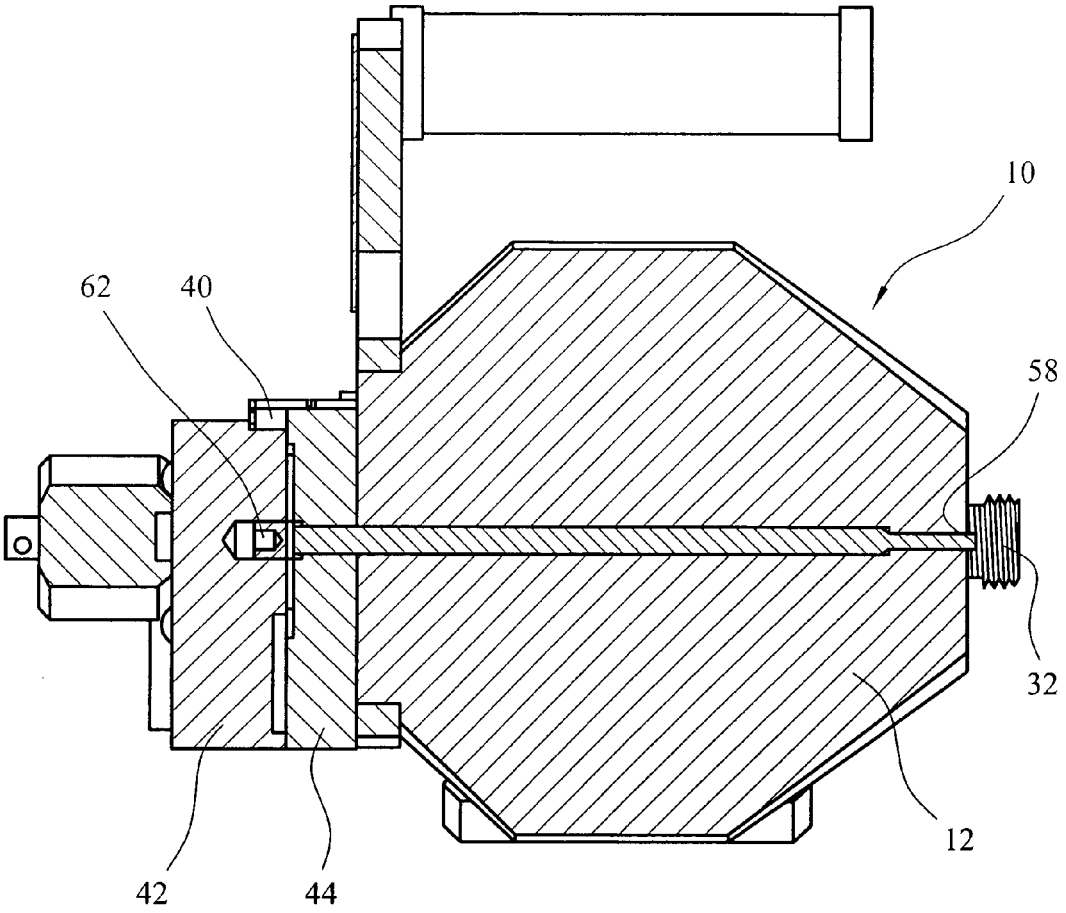
FIG. 9 shows a cross-sectional view of the plane C-C of a radiographic projector embodying the present invention.

With reference to FIGS. 8 and 9, lock pins 56 and 58, which are coupled to corresponding plungers 60, 62, prevent the locking bar 40 from being depressed to the unlocked position unless the windout assembly and shielded ancillary component 34 are correctly connected to the projector 10. The plunger action for the windout assembly connection is achieved by a shoulder 60 in the rear lock pin 56. When the windout assembly is attached to the projector 10, by connecting the control cable of the windout assembly to the hook section 28 of the source holder 20 and by rotating the connector of the windout assembly onto screw connector 26, the rear lock pin 56 is depressed. This causes the rear lock plunger 60 to disengage from the locking bar 40. The windout assembly cannot be properly installed onto the projector 10 unless the control cable of the windout assembly is connected to the source holder 20.

When a source guide tube or other shielded ancillary component 34 is connected to the front of the radiographic projector 10, the front lock pin 58 is depressed. The pin/plunger action is transferred from the front lock pin 58 to a front lock plunger 62 by means of a rod 64, causing the front lock pin 58 to disengage from the locking bar 40. In the preferred embodiment, the rod 64 is formed from tungsten powder suspended in a light material matrix.

The locking bar 40 can also be secured in the locked position by a mechanical lock 36. The mechanical lock 36 is mounted in a hole 66 in the lower front face of the front plate 42 of the lock assembly 30. The mechanical lock 36 includes a key-operated plunger 68 which can be operated to engage into an opening 70 in the locking bar 40 when the locking bar 40 is depressed, thereby restricting further movement. When the mechanical lock 36 is released it clears the path of the locking bar 40 and allows the locking bar 40 to move.

The lock assembly 30 further comprises a latch section 72, a source transit tube 74 and a spring block 76, which cooperate with the locking bar 40 to maintain the locking bar 40 in the unlocked position until the source holder 20 is returned to its storage position.

The latch section 72 is positioned between the locking bar 40 and the radiation shield 12, and is biased towards the locking bar 40 by springs 78 installed between the latch section 72 and the radiation shield 12. The action of pushing the locking bar 40 downward forces the latch section 72 away from the plane of the locking bar 40 as fins 80 on the locking bar 40 move over chamfered edges 82 on the latch section 72. When the fins 80 align with recesses 84 in the latch section 72, the latch section 72 is returned to its normal position by the action of the springs 78. This engages the fins 80 in the recesses 84 to prevent the locking bar 40 from returning upwards to the raised position. With the locking bar 40 latched at its lowest point in this way, in its unlocked position, the source holder 20 can be progressed along the channel 22 by operation of the windout assembly.

The source transit tube 74 is partially located in the channel 22 of the projector 10 and can slide forwards and backwards along the channel 22. The rearward end of the source transit tube 74 passes through the opening 46 in the locking bar 40. The locking bar 40 is only able to lock the source holder 20 when both the source holder 20 and the source transit tube 74 are in the correct storage position, in which position the fin 50 on the locking bar 40 can travel through a rebate in the source transit tube 74 to engage the recess 48 in the source holder 20.

The diameter of the source transit tube 74 is such that most of the source holder 20 can pass through the source transit tube 74, except for a final link 90 of the source holder 20, which is too large. This enables a coupling between the movement of the source transit tube 74 and the source holder 20.

The spring block 76 resides in a guide hole in the front plate 42, and biases the source transit tube 74 in the forward direction. However, when the source holder 20 is in its storage position in the projector 10, the final link 90 of the source holder 20 abuts the forward end of the source transit tube 74 and holds the source transit tube 74 in a retracted position, against the force of the spring block 76. This is because the frictional force associated with the source holder 20 and windout cable is sufficiently strong to counteract the biasing force of the spring block 76. Thus, when the locking bar 40 is initially depressed to the unlocked position, there is no movement of the source transit tube 74 or source holder 20, as the spring block 76 is too weak to push the source transit tube 74 forward against the frictional forces.

Once the locking bar 40 is in the depressed (unlocked) position, the windout assembly can be operated to progress the source holder 20 forwards along the channel 22 away from the source transit tube 74. This frees the source transit tube 74 to be pushed forwards by the spring block 76. As the source transit tube 74 moves forward, a notch or interlock portion 92 of the source transit tube 74 engages on the latch section 72 and disengages the latch section 72 from the locking bar 40. Just prior to this, the interlock portion 92 of the source transit tube 74 engages onto the locking bar 40 to prevent the locking bar 40 returning to its locked position. Therefore the locking bar 40 is maintained in the unlocked mode throughout the transition from the latch section 72 suspending the locking bar 40 to the interlock portion of the source transit tube 74 suspending the locking bar 40. During this transition, the locking bar 40 moves 0.5 mm upwards, which is sufficient to misalign the fins 80 of the locking bar 40 from the recesses 84 of the latch section 72. This ensures that when the source transit tube 74 returns to its home position (when the source holder 20 returns to its storage position) the locking bar 40 can move vertically upwards to lock the source holder 20 in place.

When the source holder 20 is retracted back into the projector 10 by operating the windout assembly in reverse, the final link 90 on the source holder 20 (that on the opposing end to the hook section 28) contacts the front end of the source transit tube 74 and pulls the source transit tube 74 rearward. This movement depresses the spring block 76 in the guide hole in the front plate 42 and disengages the interlock portion of the source transit tube 74 from the locking bar 40. The locking bar 40 then returns to the raised (locked) position due to the action of the springs which bias the locking bar 40 upwards. The source 18 is thus locked in position. The interlock mechanism provided by the source transit tube 74 prevents the lock assembly 30 being operated until the source holder 20 has been fully retracted into the projector 10, that is, until the radioisotope 18 has been returned to the radiographic projector 10.

The advantage of the latch section 72 in the locking mechanism described above is that it allows the locking bar 40 to be moved to the unlocked position without requiring or causing any movement of the source holder 20. The force exerted by the spring block 76 on the source transit tube 74 is too small to push the source transit tube 74 forward when the source holder 20 is in the storage position. The source transit tube 74 cannot move forward until the source holder 20 is progressed forward by operation of the windout assembly. Thus the source holder 20 remains stationary inside the radiation shield 12 until the windout assembly is operated. This is advantageous as it allows the operator to retreat to a safe working distance before using the windout assembly to expose the source 18.

Projectors having different masses of shielding material are provided for housing different radioisotopes. In this way, radioisotopes having a relatively low activity can be transported in projectors having a relatively low weight. However, it is important that high activity radioisotopes requiring a high degree of shielding are only installed, transported or used in a projector 10 that provides sufficient shielding material.

For this reason, the lock assembly 30 of each projector 10 is designed such that the lock may not be operated when it is attempted to install a source holder 20 intended for carrying a radioisotope 18 having too high an activity for that projector 10. This is achieved by providing source holders of different lengths for carrying radioisotopes of different activities. In particular, the position of the recess 48 in the source holder 20 is matched to the relevant dimensions of the locking mechanism 30 with which it is to be used. The locking bar 40 can only be raised to the locked position when the source transit tube 74 is retracted, and the recess of the source holder 20 is aligned with the fin 50 of the locking bar 40. If the distance between the recess 48 and final link 90 of the source holder 20 is not correctly matched to the distance between the end of the source transit tube 74 and the position of the fin 50 of the locking bar 40, it will not be possible to operate the lock to correctly lock the radioisotope 18 in the projector 10. This will alert the user that the source holder 20 is not being installed into the correct projector 10, thereby preventing the installation of a source holder 20 intended for carrying a radioisotope 18 having too high an activity for that projector 10.

With reference to FIGS. 1 to 4, the radiographic projector 10 has a handle assembly 14 constructed from a high grade of corrosion resistant steel. The handle assembly 14 comprises a handle mount 94, which extends vertically from the rear face of the radiation shield 12 and in which a steel handle pin 96 is installed. An extended polymer grip 98 may be installed over this steel pin 96 to allow ergonomic handling. The steel handle pin 96 may be removed by an unscrewing action. A series of alternatives can be supplied with the projector 10 such as a lifting eyelet for hoisting the projector 10.

Two bars 16 of circular cross-section are mounted on the lower side of the radiation shield 12. These bars 16 act as feet, ensuring the projector 10 does not roll or tip, since the radiation shield 12 is largely circular in profile. The separation between the two bars 16 is selected to achieve a reasonable trade off between stability and the diameter or mass of the bars 16. The profile of the feet 16 has also been chosen to allow the projector 10 to be installed in a mount which allows the projector 10 to slide in a direction parallel to the direction of travel of the source 18.

Figure 10:
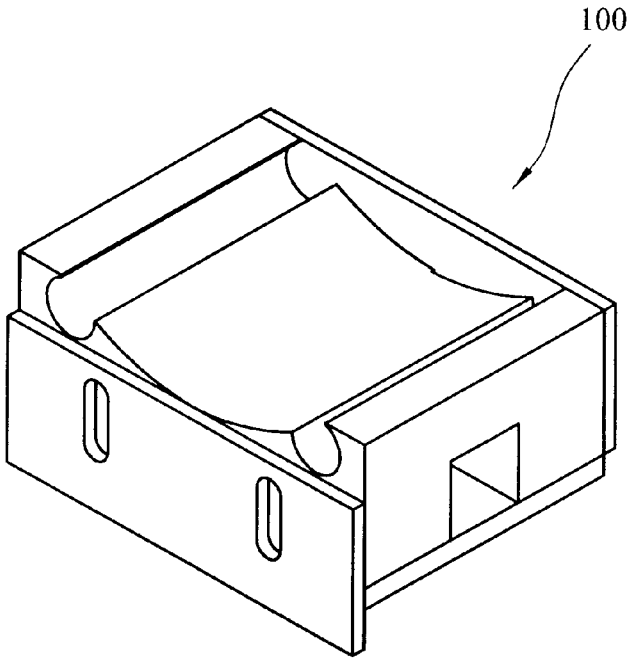
FIG. 10 shows a holster for use with a radiographic projector embodying the present invention.

The radiographic projector 10, with either a shielded ancillary component 34 or a guide tube attached, can be loaded in a projector holster 100, shown in FIG. 10. The projector holster 100 can be manipulated and set up on a work piece or in a desired position without the projector 10 attached. The projector 10 can then be installed at the last moment. This allows the alignment steps to be carried out without having to manipulate the projector 10, which might typically weigh around 20 kg. It also lowers the radiation dose experienced by the operator as the time for which the operator is in close proximity to the projector 10 is significantly reduced.

Figure 11:
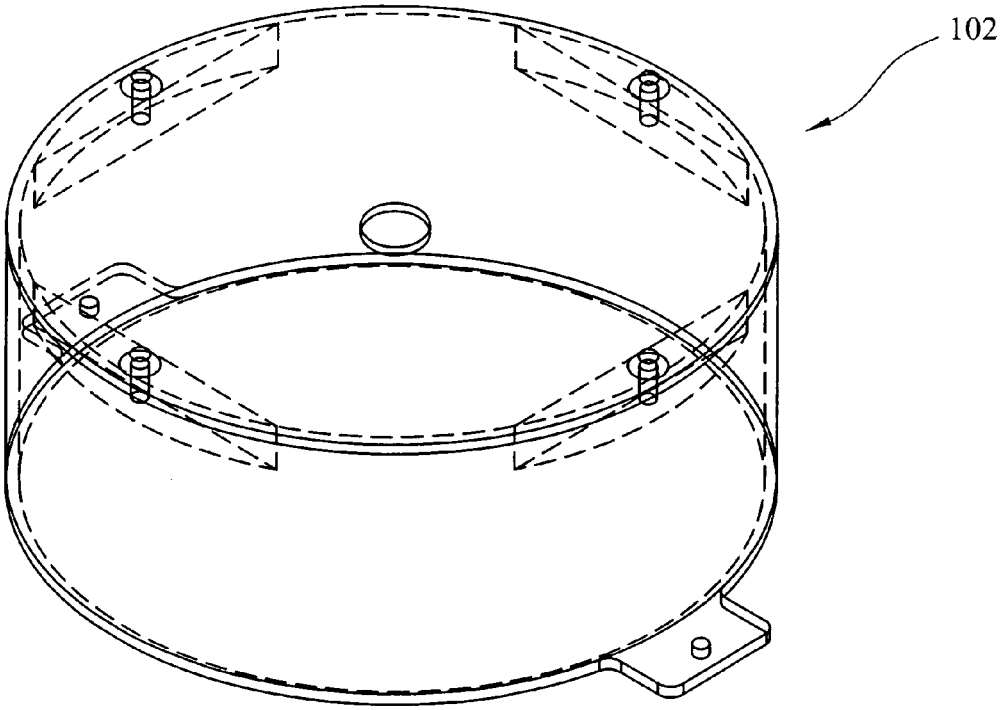
FIG. 11 shows a retraction cage for a remote windout assembly for use with a radiographic projector embodying the present invention.

Unlike conventional windout systems, the windout assembly of the present invention includes a retraction cage 102, shown in FIG. 11. The control cable of the windout assembly is attached to the hook section 28 of the source holder 20, and passes through a hose or cable housing to the drive gear of the windout assembly. Cranking the drive gear of the windout assembly exposes the source holder 20. In a conventional windout assembly, the free end of the control cable resides in a second hose or cable housing, which also extends between the gear wheel and the projector 10. In the present invention, the free end of the control cable is spooled in the retraction cage 102, so that only one cable housing is required. This reduces the weight of the windout assembly, and allows a more reliable windout to be constructed.

It will be appreciated by persons skilled in the art that the above embodiments have been described by way of example only, and not in any limitative sense, and that various alterations and modifications are possible without departure from the scope of the invention as defined by the appended claims.

The invention claimed is:

1. A radiographic projector for housing a radioisotope, the apparatus comprising:

a first radiation shield for housing a radioisotope;

a second radiation shield;

the first radiation shield defining a surface for removably receiving in surface-to-surface contact the second radiation shield;

a connector for connecting said first radiation shield to said second radiation shield;

wherein a first portion of said surface defines an aperture through which a radioisotope located in the first radiation shield may be projected out of the first radiation shield; and a second portion of said surface is inclined relative to a plane of said aperture.

2. A radiographic projector according to claim 1, wherein said second portion surrounds said first portion.

3. A radiographic projector according to claim 1, wherein said first radiation shield comprises a channel along which a radioisotope may be moved, said channel being in communication with said aperture.

4. A radiographic projector according to claim 3, wherein said first portion is substantially orthogonal to said channel.

5. A radiographic projector according to claim 1, wherein said first portion of said surface is located at an end of said first radiation shield, and said second portion of said surface is a chamfered edge of said first radiation shield.

6. A radiographic projector according to claim 1, wherein said surface of said first radiation shield is formed of a radiation absorbent material.

7. A radiographic projector according to claim 6, wherein said radiation absorbent material comprises at least one of depleted uranium, tungsten, lead, or tungsten powder in a binder.

8. A radiographic projector according to claim 1, further comprising a second radiation shield, adapted to removably engage said surface of said first radiation shield.

9. A radiographic projector according to claim 8, wherein said second radiation shield is a collimator.

10. A radiographic projector according to claim 8, wherein said second radiation shield is a guide tube.

11. A radiographic projector for housing a radioisotope, the radiographic projector comprising:

a first radiation shield for housing a radioisotope;

a second radiation shield;

the first radiation shield defining a surface for removably engaging in surface-to-surface contact said second radiation shield;

a connector for connecting said first radiation shield to said second radiation shield;

wherein a first portion of said surface defines an aperture through which a radioisotope located in the first radiation shield may be projected out of the first radiation shield; and said surface of said first radiation shield comprises a radiation absorbent material.

12. A radiographic projector according to claim 11, wherein said radiation absorbent material comprises tungsten.

13. A radiographic projector according to claim 11, wherein said radiation absorbent material comprises tungsten powder in a less dense material matrix.

14. A radiographic projector as claimed in claim 3, further comprising a source holder assembly in which a radioisotope may be moved along said channel, wherein at least parts of said source holder assembly comprise a shielding material for shielding radiation emitted by said radioisotope in forward and backward directions along said channel.

15. A radiographic projector according to claim 11, wherein said first radiation shield comprises a channel along which a radioisotope may be moved, said channel being in communication with said aperture; and further comprising a source holder assembly in which a radioisotope may be moved along said channel, wherein at least parts of said source holder assembly comprise a shielding material for shielding radiation emitted by said radioisotope in forward and backward directions along said channel.

* * * * *